US007561120B2

(12) United States Patent
Lee et al.

(10) Patent No.: US 7,561,120 B2
(45) Date of Patent: Jul. 14, 2009

(54) METHOD AND APPARATUS OF DRIVING PLASMA DISPLAY PANEL

(75) Inventors: Hyun Oh Lee, Daegu (KR); Yun Kwon Jung, Gumi-si (KR)

(73) Assignee: LG Electronic s Inc., Seoul (KR)

( * ) Notice: Subject to any disclaimer, the term of this patent is extended or adjusted under 35 U.S.C. 154(b) by 754 days.

(21) Appl. No.: 10/993,145

(22) Filed: Nov. 22, 2004

(65) Prior Publication Data

US 2005/0116895 A1 Jun. 2, 2005

(30) Foreign Application Priority Data

Nov. 21, 2003 (KR) ..... 10-2003-0082947

(51) Int. Cl.
*G09G 3/28* (2006.01)

(52) U.S. Cl. ..... 345/60

(58) Field of Classification Search ..... 345/60–72
See application file for complete search history.

(56) References Cited

U.S. PATENT DOCUMENTS 6,249,087 B1 * 6/2001 Takayama et al. ..... 315/169.1
6,483,250 B1 11/2002 Hashimoto et al.
6,653,795 B2 * 11/2003 Kang et al. ..... 315/169.3
6,876,343 B2 * 4/2005 Myoung et al. ..... 345/67
7,286,102 B2 * 10/2007 Yoon et al. ..... 345/60
2002/0080097 A1 6/2002 Tokunaga et al.

FOREIGN PATENT DOCUMENTS

| | | |
|---|---|---|
| CN | 1339771 | 3/2002 |
| JP | 2002196720 | 7/2002 |
| JP | 2004110693 | 4/2004 |

* cited by examiner

*Primary Examiner*—Bipin Shalwala
*Assistant Examiner*—Steven E Holton
(74) *Attorney, Agent, or Firm*—McKenna Long & Aldridge LLP

(57) ABSTRACT

A method and apparatus drives a plasma display panel in which a margin of an address discharge and a sustain discharge is increased through a stabilized reset operation. According to an embodiment, the method of driving the PDP includes the steps of applying a first ramp-down pulse having a first tilt to scan electrodes in the first half of a set-down period included in a reset period, applying a ground voltage to the scan electrodes in the middle phase of the set-down period, and applying a second ramp-down pulse having a second tilt to the scan electrodes in the second half of the set-down period.

22 Claims, 9 Drawing Sheets

METHOD AND APPARATUS OF DRIVING PLASMA DISPLAY PANEL

This Nonprovisional application claims priority under 35 U.S.C. § 119(a) on U.S. patent application No. 10-2003-0082947 filed in Korea on Nov. 21, 2003, the entire contents of which are hereby incorporated by reference.

BACKGROUND OF THE INVENTION

1. Field of the Invention

The present invention relates to a method of driving a plasma display panel and apparatus thereof, and more particularly, to a method of driving a plasma display panel in which the margin of an address discharge and a sustain discharge are increased through a stabilized reset operation, apparatus thereof.

2. Description of the Background Art

A plasma display panel (hereinafter, referred to as a 'PDP') is adapted to display an image by light-emitting phosphors with ultraviolet generated during the discharge of an inert mixed gas such as He+Xe, Ne+Xe or He+Ne+Xe. This PDP can be easily made thin and large, and it can provide greatly increased image quality with the recent development of the relevant technology.

FIG. 1 is a perspective view illustrating the construction of a discharge cell of a three-electrode AC surface discharge type PDP in a prior art.

Referring to FIG. 1, the discharge cell of the three-electrode AC surface discharge type PDP includes a scan electrode 30Y and a sustain electrode 30Z which are formed on the bottom surface of an tipper substrate 10, and an address electrode 20X formed on a lower substrate 18. The scan electrode 30Y includes a transparent electrode 12Y, and a metal bus electrode 13Y which has a line width smaller than that of the transparent electrode 12Y and is disposed at one edge side of the transparent electrode. The sustain electrode 30Z includes a transparent electrode 12Z, and a metal bus electrode 13Z which has a line width smaller than that of the transparent electrode 12Z and is disposed at one side edge of the transparent electrode.

The transparent electrodes 12Y, 12Z, which are typically made of ITO (indium tin oxide), are formed on the bottom surface of the upper substrate 10. The metal bus electrodes 13Y, 13Z, which are typically made of chrome (Cr), are formed on the transparent electrodes 12Y, 12Z, and serve to reduce a voltage drop caused by the transparent electrodes 12Y, 12Z having high resistance. On the bottom surface of the upper substrate 10 in which the scan electrodes 30Y and the sustain electrodes 30Z are placed in parallel with each other are laminated an upper dielectric layer 14 and a protective layer 16. On the upper dielectric layer 14 are accumulated wall charges generated during plasma discharge. The protective layer 16 serves to prevent the upper dielectric layer 14 from being damaged due to sputtering generated during the plasma discharge, and improve efficiency of secondary electron emission. Magnesium oxide (MgO) is typically used as the protective layer 16.

A lower dielectric layer 22 and barrier ribs 24 are formed on the lower substrate 18 in which the address electrode 20X is formed. A phosphor layer 26 is coated on the surface of the lower dielectric layer 22 and barrier ribs 24. The address electrodes 20X are formed in the direction in which they intersect the scan electrodes 30Y and the sustain electrodes 30Z. The barrier ribs 24 are formed in parallel with the address electrodes 20X to prevent ultraviolet and a visible ray generated by the discharge from leaking toward neighboring discharge cells. The phosphor layer 26 is excited with an ultraviolet generated during the plasma discharging to generate a visible light of any one of red, green and blue lights. An inert mixed gas is injected into the discharge spaces defined between the upper substrate 10 and the barrier ribs 24 and between the lower substrate 18 and the barrier ribs 24.

The PDP is time-driven with one frame being divided into several sub-fields having a different number of emission in order to implement the gray scale of an image. Each of the sub-fields is divided into a reset period for initializing the entire screen, an address period for selecting a scan line and selecting a cell from the selected scan line, and a sustain period for implementing the gray scale depending on the number of a discharge.

In this time, the reset period is divided into a set-up period where a ramp-up pulse is supplied and a set-down period were a ramp-down pulse is supplied, in plural. For example, if it is desired to display an image with 256 gray scale, a frame period (16.67 ms) corresponding to 1/60 seconds is divided into eight sub-fields SF1 to SF8, as shown in FIG. 2. Furthermore, each of the eight sub-fields SF1 to SF8 is subdivided into a reset period, an address period and a sustain period. In this time, the reset period and the address period of each of the sub-fields are the same every sub-field, whereas the sustain period and the number of a sustain pulse allocated thereto are increased in the ratio of 2n(n=0,1,2,3,4,5,6,7) in each sub-field.

FIG. 3 shows a driving waveform of a PDP, which is supplied two sub-fields.

In FIG. 3, Y indicates scan electrodes, Z indicates sustain electrodes and X indicates address electrodes.

Referring to FIG. 3, the PDP is driven with it being divided into a reset period for initializing the entire screen, an address period for selecting a cell, and a sustain period for maintaining a discharge of the selected cell.

In a set-up period of the reset period, a ramp-up pulse Ramp-up is applied to all scan electrodes Y at the same time. A weak discharge is generated within cells of the entire screen by means of the ramp-up pulse Ramp-up and wall charges are thus created within the cells. In a set-down period, a ramp-down pulse Ramp-down, which drops from a voltage of the positive polarity lower than the peak voltage of the ramp-up pulse Ramp-up, is applied to the scan electrodes Y at the same time. The ramp-down pulse Ramp-down generates a weak erase discharge within the cells, so that the wall charges generated by the set-up discharge and unnecessary charges among space charges are erased and wall charges necessary for an address discharge uniformly remain within the cells of the entire screen.

In the address period, simultaneously when a scan pulse scan of the negative polarity is sequentially applied to the scan electrodes Y, a data pulse data of the positive polarity is applied to the address electrodes X. As a voltage difference between the scan pulse scan and the data pulse data and a wall voltage generated in the reset period are added, the address discharge is generated within cells to which the data pulse data is applied. Also, wall charges are generated within cells selected by the address discharge.

Meanwhile, during the set-down period and the address period, a positive-polarity DC voltage of a sustain voltage level (Vs) is applied to the sustain electrodes Z.

In the sustain period, a sustain pulse Sus is alternately applied to the scan electrodes Y and the sustain electrodes Z. Then, in cells selected by the address discharge, a sustain discharge is generated between the scan electrodes Y and the sustain electrodes Z in the surface discharge shape whenever the sustain pulse Sus is applied as the wall voltage within the cells and the sustain pulse Sus are added. Lastly, after the sustain discharge is completed, an erase ramp pulse erase having a narrow pulse width is applied to the sustain electrodes Z, thus erasing the wall charges within the cells.

Meanwhile, there has been proposed a structure in which a discharge space is widened by increasing the height h of a barrier rib 24 so as to improve the emission efficiency of the PDP, as shown in FIG. 4. If the height of the barrier rib 24 is increased, however, a discharge firing voltage of an opposite discharge is increased. It is thus necessary to further lower the voltage of the ramp-down pulse Ramp-down. In this case, an excessive discharge is generated between the scan electrodes Y and the sustain electrodes Z. An erroneous discharge is thus generated in the address period or the sustain period.

This will be below described in detail. If the ramp-up pulse Ramp-up is applied to the scan electrodes Y in the set-up period, a discharge is generated between the scan electrodes Y and the sustain electrodes Z. Wall charges of the negative polarity are thus formed in the scan electrodes Y, as shown in FIG. 5*a*. It in turn means that a voltage of the negative polarity is applied to the sustain electrodes Z and the address electrodes X compared with the scan electrodes Y. Wall charges of the positive polarity are thus formed in the sustain electrodes Z and the address electrodes X. Thereafter, if the ramp-down pulse Ramp-down is applied to the scan electrodes Y and the DC voltage of the positive polarity is applied to the sustain electrodes Z in a set-down period, a weak discharge is generated between the scan electrodes Y and the sustain electrodes Z, thus erasing the wall charges. Accordingly, wall charges are formed, as shown in FIG. 5*b*. If the height of the barrier rib is increased so as to improve the discharge efficiency, however, a distance between the scan electrodes Y and the address electrodes Z becomes far. Therefore, in order to generate a discharge between the scan electrodes Y and the address electrodes X, it is required that the ramp-down pulse Ramp-down be lower than the discharge firing voltage for generating the discharge between the scan electrodes Y and the address electrodes X. Accordingly, an excessive discharge is generated between the scan electrodes Y and the sustain electrodes Z, the wall charges in the scan electrodes Y and the sustain electrodes Z are excessively erased, as shown in FIG. 5*c*. Therefore, there is a problem in that the margin of the address discharge and the sustain discharge is lowered since the wall charges are severely reversed.

SUMMARY OF THE INVENTION

Accordingly, the present invention has been made in view of the above problems, and it is an object of the present invention to provide a method of driving a plasma display panel in which a discharge can be generated stably.

According to an embodiment of the present invention, a method of driving a plasma display panel includes the step of alternately applying a first sustain pulse to scan electrode lines and sustain electrode lines during a sustain period with a first period intervened between the sustain periods. In this time, a last sustain pulse applied to the scan electrode lines during the sustain period is applied after a second period that is longer than the first period.

According to another embodiment of the present invention, a method of driving a plasma display panel in which one frame includes a plurality of selective write sub-fields and selective erase sub-fields includes the steps of alternately applying a first sustain pulse to scan electrode lines and sustain electrode lines during a sustain period of at least one of the plurality of the selective write sub-fields with a first period intervened between the sustain periods, and applying a last sustain pulse applied to the scan electrode lines after a second period that is longer than the first period.

According to still another embodiment of the present invention, a method of driving a plasma display panel includes applying a last sustain pulse having a long pulse width, which is supplied to scan electrode lines in a last selective write sub-field, after sustain pulses that are provided previously. Accordingly, more particularly, in a low temperature environment, a stabilized sustain discharge can be generated by the last sustain pulse having the long pulse width. Thus, a stabilized address discharge can be generated in the address period of the selective erase sub-field.

According to an embodiment of the present invention, there is provided a method of driving a plasma display panel, including the steps of applying a first ramp-down pulse having a first tilt to scan electrodes in the first half of a set-down period included in a reset period, applying a ground voltage to the scan electrodes in the middle phase of the set-down period, and applying a second ramp-down pulse having a second tilt to the scan electrodes in the second half of the set-down period.

According to an embodiment of the present invention, there is provided a method of driving a plasma display panel in which a reset period is divided into a set-up period and a set-down period and is then driven, including a first step in which wall charges are formed in a discharge cell during the set-up period, a second step in which some of the wall charges is erased by a discharge between scan electrodes and sustain electrodes during the first half of the set-down period, and a third step in which some of the wall charges is erased by a discharge between the scan electrodes and address electrodes in the second half of the set-down period.

According to an embodiment of the present invention, there is provided an apparatus for driving a plasma display panel, including a scan driving unit that supplies a first ramp-down pulse which drops from a sustain voltage to a ground voltage at a first tilt in the first half of a set-down period included in the reset period, supplies the ground voltage in the middle phase of the set-down period, and supplies a second ramp-down pulse which drops from the ground voltage to a voltage of the negative polarity at a second tilt in the second half of the set-down period; and a sustain driving unit that supplies the sustain voltage in the first half of the set-down period and the ground voltage in the second half of the set-down period.

The present invention has an effect in that it can generate a reset discharge and an address discharge stably.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Figure 1:
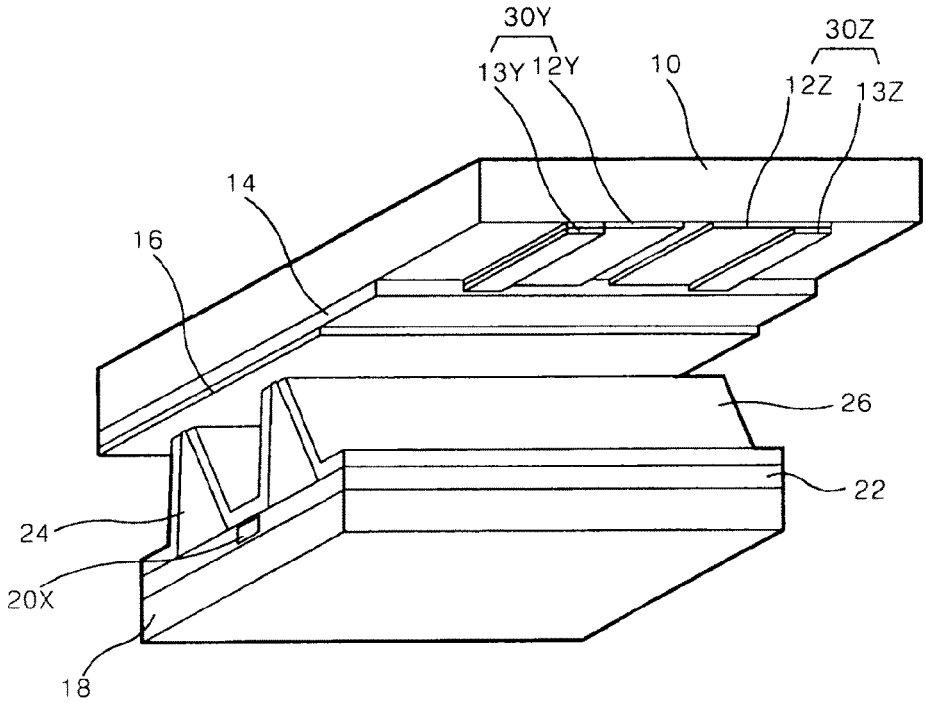
Fig. 1 Related Art
FIG. 1 is a perspective view illustrating the construction of a three-electrode AC surface discharge type PDP in a prior art.
Figure 2:
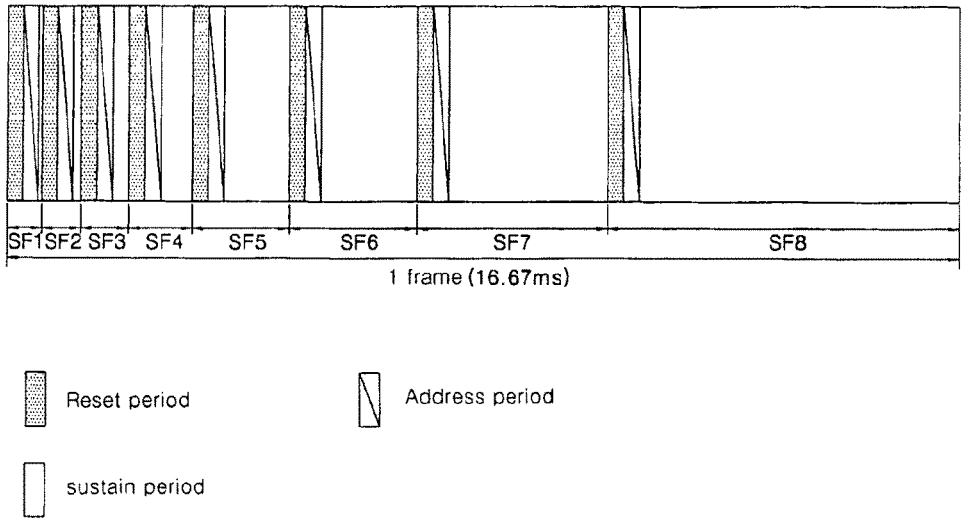
Fig. 2 Related Art
FIG. 2 shows one frame of the AC surface discharge type PDP in the prior art.
Figure 3:
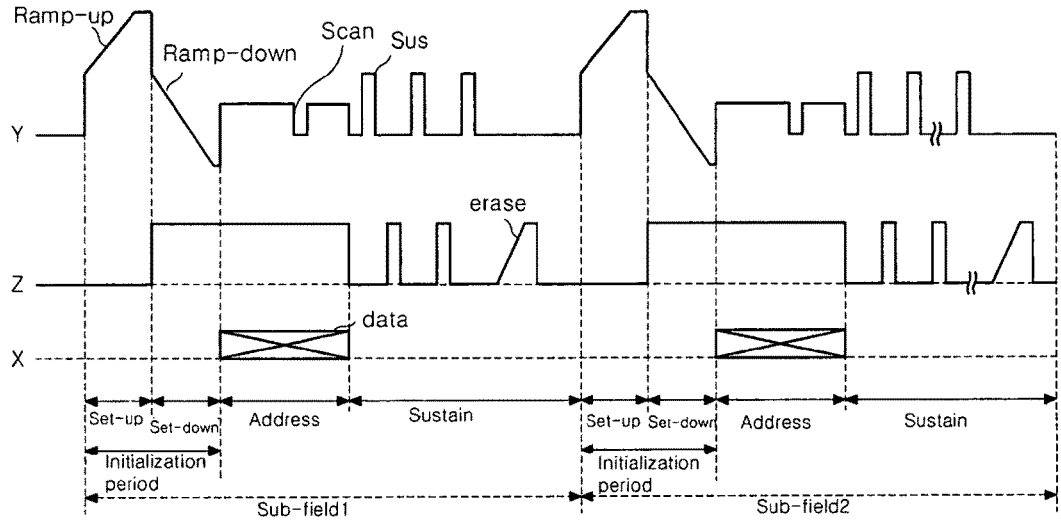
Fig. 3 Related Art
FIG. 3 shows a driving waveform which is provided to the electrodes during the sub-field shown in FIG. 2.
Figure 4:
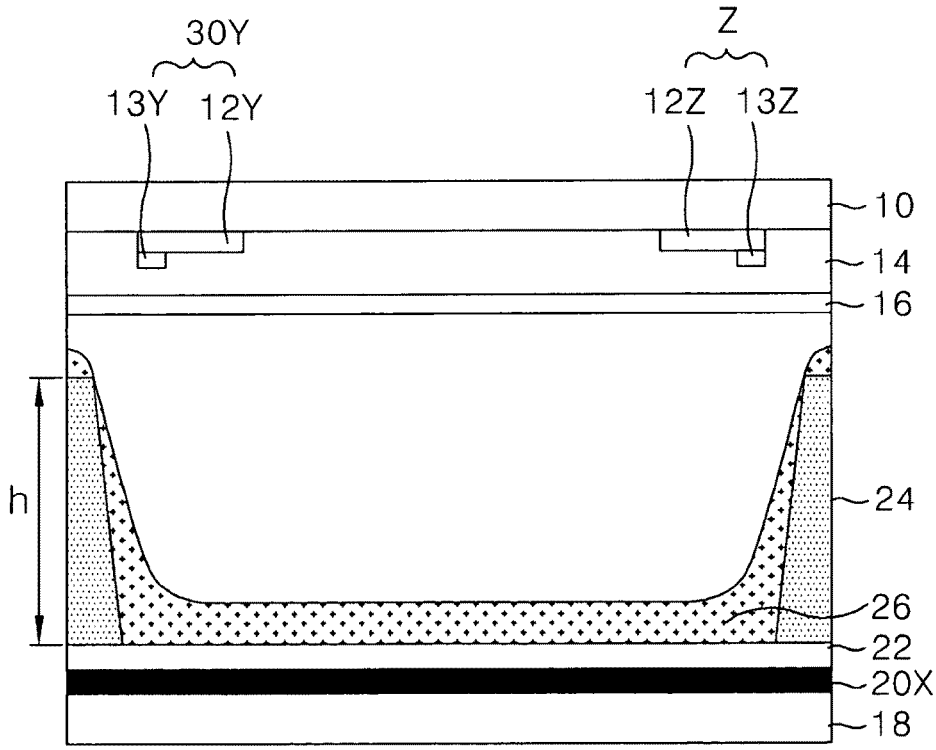
Fig. 4 Related Art
FIG. 4 is a cross-sectional view showing a plasma display panel having a barrier rib of a height h.
Figure 5A:
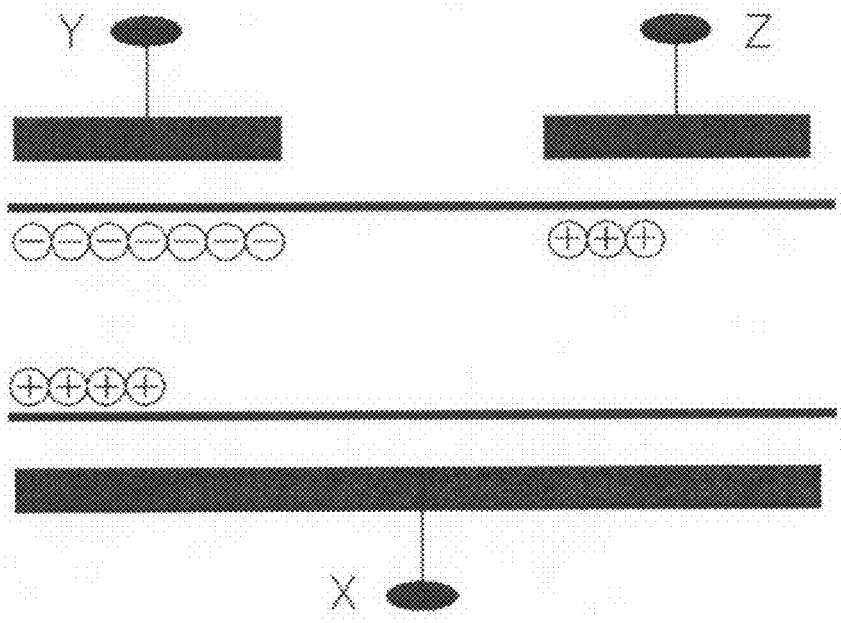
Fig. 5a Related Art
FIG. 5*a* shows wall charges formed in the set-up period of the reset period in the driving waveform shown in FIG. 3.
Figure 5B:
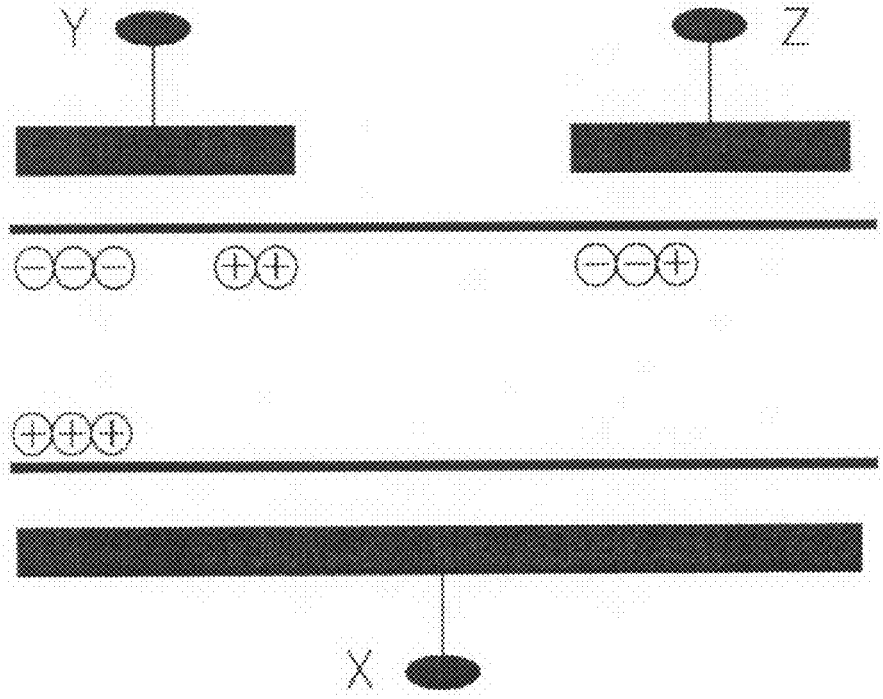
Fig. 5b Related Art
FIG. 5*b* shows wall charges that must be formed in the set-down period of the reset period in the driving waveform shown in FIG. 3.
Figure 5C:
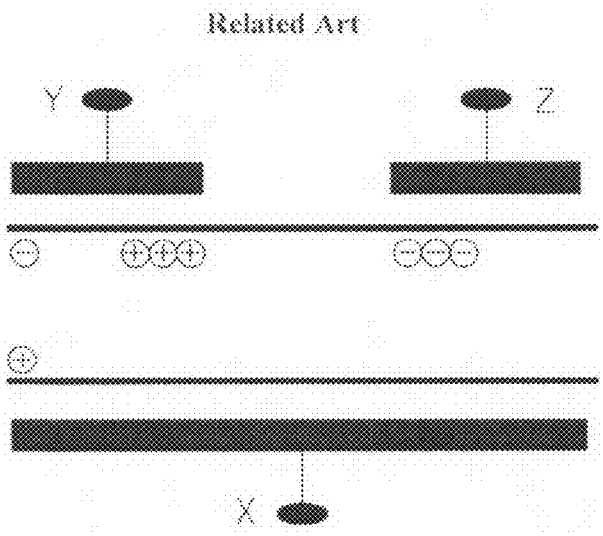
FIG. 5*c* shows wall charges formed in the set-down period of the reset period when the driving waveform shown in FIG. 3 is supplied to the PDP shown in FIG. 4.

Preferred embodiments of the present invention will be described in a more detailed manner with reference to the drawings.

Accordingly, the present invention has been made in view of the above problems, and it is an object of the present invention to provide a method of driving a plasma display panel in which a discharge can be generated stably.

According to an embodiment of the present invention, a method of driving a plasma display panel includes the step of alternately applying a first sustain pulse to scan electrode lines and sustain electrode lines during a sustain period with a first period intervened between the sustain periods. In this time, a last sustain pulse applied to the scan electrode lines during the sustain period is applied after a second period that is longer than the first period.

According to another embodiment of the present invention, a method of driving a plasma display panel in which one frame includes a plurality of selective write sub-fields and selective erase sub-fields includes the steps of alternately applying a first sustain pulse to scan electrode lines and sustain electrode lines during a sustain period of at least one of the plurality of the selective write sub-fields with a first period intervened between the sustain periods, and applying a last sustain pulse applied to the scan electrode lines after a second period that is longer than the first period.

According to still embodiment of the present invention, a method of driving a plasma display panel includes applying a last sustain pulse having a long pulse width, which is supplied to scan electrode lines in a last selective write sub-field, after sustain pulses that are provided previously. Accordingly, more particularly, in a low temperature environment, a stabilized sustain discharge can be generated by the last sustain pulse having the long pulse width. Thus, a stabilized address discharge can be generated in the address period of the selective erase sub-field.

According to an embodiment of the present invention, there is provided a method of driving a plasma display panel, including the steps of applying a first ramp-down pulse having a first tilt to scan electrodes in the first half of a set-down period included in a reset period, applying a ground voltage to the scan electrodes in the middle phase of the set-down period, and applying a second ramp-down pulse having a second tilt to the scan electrodes in the second half of the set-down period.

In the method of driving the plasma display panel according to an embodiment of the present invention, the first ramp-down pulse drops from a sustain voltage level to the ground voltage.

In the method of driving the plasma display panel according to an embodiment of the present invention, the second ramp-down pulse drops from the ground voltage to a voltage level of the negative polarity.

In the method of driving the plasma display panel according to an embodiment of the present invention, the voltage level of the negative polarity is a voltage of −100 V or less.

In the method of driving the plasma display panel according to an embodiment of the present invention, the first tilt and the second tilt are set to be the same.

In the method of driving the plasma display panel according to an embodiment of the present invention, the first tilt and the second tilt are set to be different.

In the method of driving the plasma display panel according to an embodiment of the present invention, the first tilt is set to be higher than the second tilt.

In the method of driving the plasma display panel according to an embodiment of the present invention, the first tilt is set to be lower than the second tilt.

In the method of driving the plasma display panel according to an embodiment of the present invention, in the first half of the set-down period, a first voltage of the positive polarity is supplied to the sustain electrodes.

In the method of driving the plasma display panel according to an embodiment of the present invention, in the second half of the set-down period, the ground voltage is supplied to the sustain electrodes.

In the method of driving the plasma display panel according to an embodiment of the present invention, a second voltage of the positive polarity, which is lower than the first voltage of the positive polarity, is supplied to the sustain electrodes during an address period.

According to an embodiment of the present invention, there is provided a method of driving a plasma display panel in which a reset period is divided into a set-up period and a set-down period and is then driven, including a first step in which wall charges are formed in a discharge cell during the set-up period, a second step in which some of the wall charges is erased by a discharge between scan electrodes and sustain electrodes during the first half of the set-down period, and a third step in which some of the wall charges is erased by a discharge between the scan electrodes and address electrodes in the second half of the set-down period.

The method of driving the plasma display panel according to an embodiment of the present invention further includes the step of supplying a ground voltage to the scan electrodes between the second and third steps.

According to an embodiment of the present invention, there is provided an apparatus for driving a plasma display panel, including a scan driving unit that supplies a first ramp-down pulse which drops from a sustain voltage to a ground voltage at a first tilt in the first half of a set-down period included in the reset period, supplies the ground voltage in the middle phase of the set-down period, and supplies a second ramp-down pulse which drops from the ground voltage to a voltage of the negative polarity at a second tilt in the second half of the set-down period; and a sustain driving unit that supplies the sustain voltage in the first half of the set-down period and the ground voltage in the second half of the set-down period.

In the apparatus of driving the plasma display panel according to an embodiment of the present invention, the sustain driving unit supplies a voltage of the positive polarity that is lower than the sustain voltage to sustain electrodes during the address period.

In the apparatus of driving the plasma display panel according to an embodiment of the present invention, the first tilt and the second tilt are set to be the same.

In the apparatus of driving the plasma display panel according to an embodiment of the present invention, the first tilt and the second tilt are set to be different.

In the apparatus of driving the plasma display panel according to an embodiment of the present invention, the first tilt is set to be higher than the second tilt.

In the apparatus of driving the plasma display panel according to an embodiment of the present invention, the first tilt is set to be lower than the second tilt.

In the apparatus of driving the plasma display panel according to an embodiment of the present invention, the scan driving unit includes a first ramp supply unit for supplying the first ramp-down pulse having the first tilt, and a second ramp supply unit for supplying the second ramp-down pulse having the second tilt.

In the apparatus of driving the plasma display panel according to an embodiment of the present invention, the first ramp supply unit includes a first switch connected between a sustain voltage source and a ground voltage source, and a first variable resistor connected to the gate terminal of the first switch, for controlling the first tilt of the first ramp-down pulse.

In the apparatus of driving the plasma display panel according to an embodiment of the present invention, the second ramp supply unit includes a second switch connected between a sustain voltage source and a negative-polarity voltage source, and a second variable resistor connected to the gate terminal of the second switch, for controlling the second tilt of the second ramp-down pulse.

In the apparatus of driving the plasma display panel according to an embodiment of the present invention, the negative-polarity voltage source supplies a voltage of −100 V or less.

Figure 6:
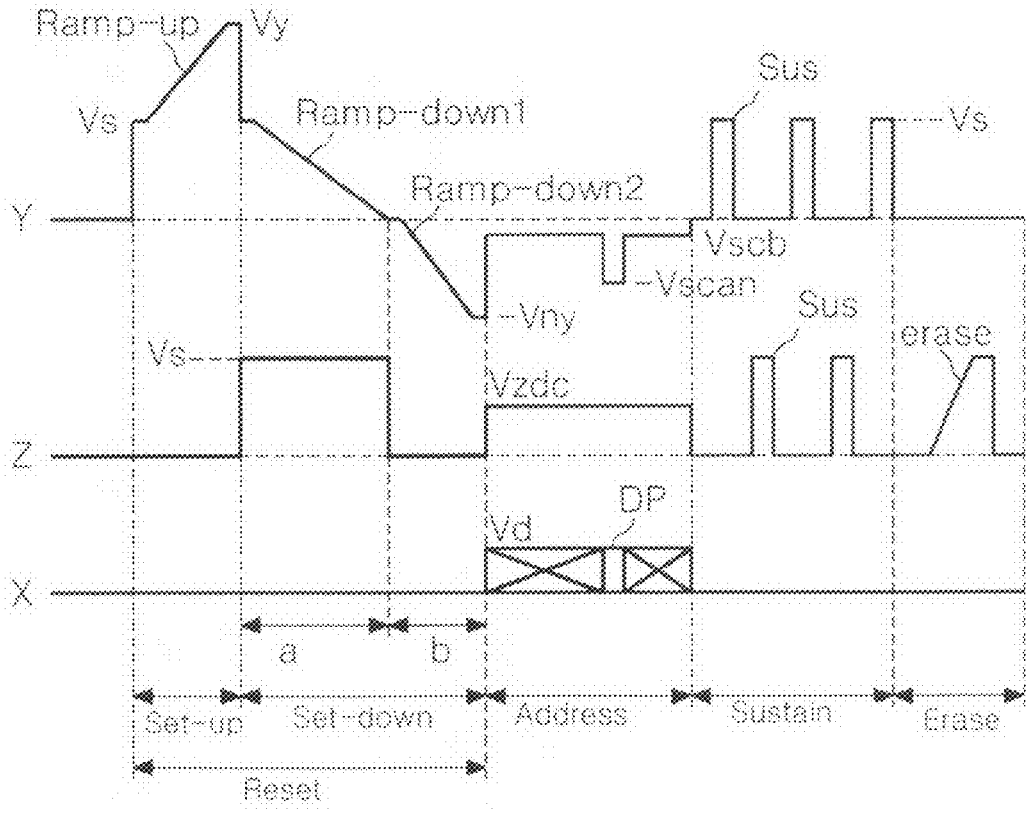
FIG. 6 shows a driving waveform for explaining a method of driving a PDP according to an embodiment of the present invention.

FIG. 6 is a waveform for explaining a method of driving a PDP according to an embodiment of the present invention the plasma display panel.

The PDP according to the present invention has a barrier rib the height of which is increased so as to improve the discharge efficiency.

In FIG. 6, Y indicates scan electrodes, Z indicates sustain electrodes and X indicates address electrodes.

Referring to FIG. 6, the PDP according to the present invention includes a reset period for initializing the entire screen, an address period for selecting a given cell, and a sustain period for maintaining a discharge of the selected cell.

Figure 7A:
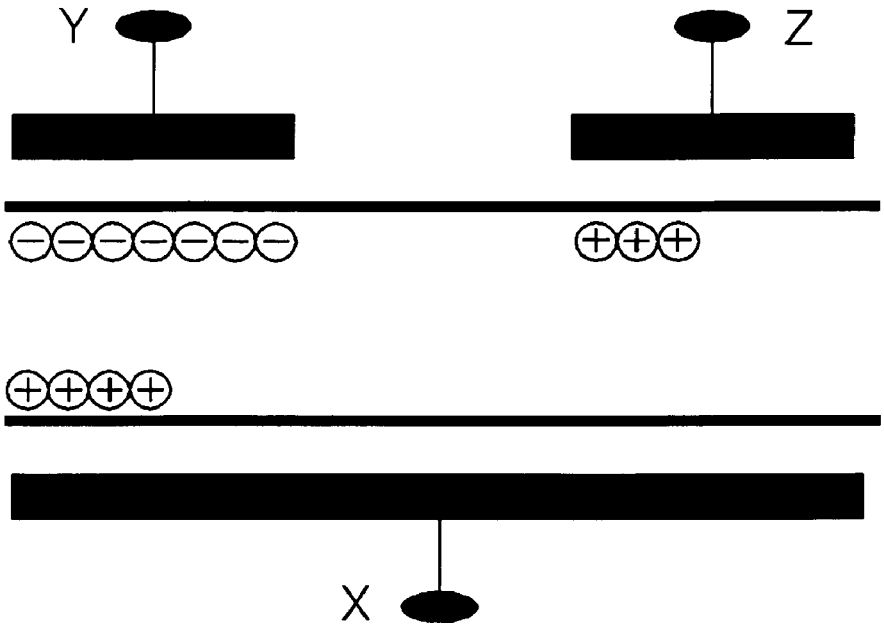
FIG. 7*a* shows wall charges formed in the set-up period of the reset period in the driving waveform shown in FIG. 6.

In a set-up period of the reset period, a ramp-up pulse Ramp-up is applied to all the scan electrodes Y at the same time. A weak discharge is generated in cells of the entire screen by the ramp-up pulse Ramp-up, so that wall charges are formed in the cells as shown in FIG. 7*a*. Furthermore, during the set-up period, the ramp-up pulse Ramp-up is raised up to a peak voltage (Vy), and the peak voltage (Vy) is then applied to the scan electrodes Y for a predetermined time. If the peak voltage (Vy) of the ramp-up pulse Ramp-up is maintained for a predetermined time, the wall charges formed in the discharge cell are enhanced.

Figure 7B:
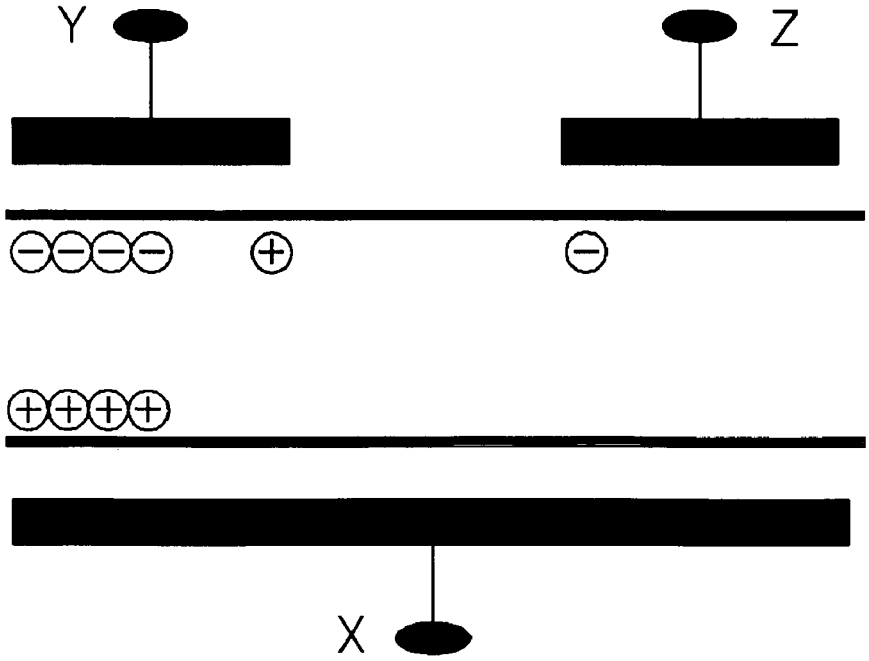
FIG. 7*b* shows wall charges formed by a first ramp-down pulse during the set-down period of the reset period in the driving waveform shown in FIG. 6.

In an "a" period of a set-down period, a first ramp-down pulse Ramp-down1 having a first tilt is applied to the scan electrodes Y. In a "b" period, a second ramp-down pulse Ramp-down2 having a second tilt is applied to the scan electrodes Y. In this time, the first tilt is set to be lower than the second tilt. In the set-down period, the first ramp-down pulse Ramp-down1, which is applied during the "a" period, drops to a ground voltage at a time point where the voltage drops from the peak voltage (Vy) to a sustain voltage (Vs). In this time, during the "a" period where the first ramp-down pulse Ramp-down1 is applied, the sustain voltage (Vs) of a positive-polarity DC voltage is applied to the sustain electrodes Z. Accordingly, an erase discharge, i.e., a dark discharge is generated within the cells between the scan electrodes Y and the sustain electrodes Z, so the wall charges generated by the set-up discharge and unnecessary charges among space charges are erased. Therefore, the wall charges are formed, as shown in FIG. 7*b*. Meanwhile, if the second ramp-down pulse Ramp-down2 is applied immediately after the first ramp-down pulse Ramp-down1 is applied, an erroneous discharge can occur between the scan electrodes Y and the sustain electrodes Z. In order to prevent this erroneous discharge, the ground voltage is applied to the scan electrodes Y for a given time.

Figure 7C:
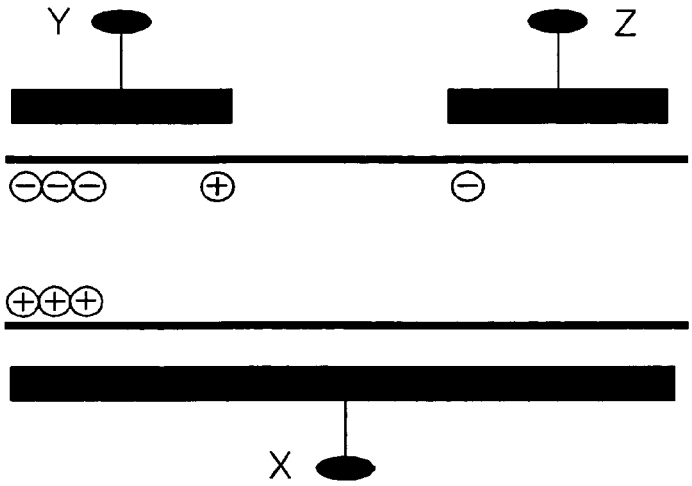
FIG. 7*c* shows wall charges formed by a second ramp-down pulse during the set-down period of the reset period in the driving waveform shown in FIG. 6.

Thereafter, in the "b" period of the set-down period, the second ramp-down pulse Ramp-down2 having the second tilt, which drops to a predetermined voltage of the negative polarity (e.g., −100 V or less), is applied to the scan electrodes Y. That is, if the height of the barrier rib is increased so as to improve the discharge efficiency, a distance between the scan electrodes Y and the address electrodes X becomes far and the discharge firing voltage is thus increased. Accordingly, a dark discharge is generated between the scan electrodes Y and the address electrodes Z by dropping the second ramp-down pulse Ramp-down2 having the second tilt below the discharge firing voltage. In this time, during the "b" period where the second ramp-down pulse Ramp-down2 is applied, the ground voltage is applied to the sustain electrodes Z. Accordingly, since a discharge is not generated between the scan electrodes Y and the sustain electrodes Z, the wall charges formed in the sustain electrodes Z are not affected. In other words, in the set-down period of the reset period, the first and second ramp-down pulses Ramp-down1, Ramp-down2, which have a different tilt, are applied to the scan electrodes Y. Therefore, the dark discharge is generated between the scan electrodes Y and the sustain electrodes Z by the first ramp-down pulse Ramp-down1, and the dark discharge is generated between the scan electrodes Y and the address electrodes X by the second ramp-down pulse Rampdown2, so that wall charges are formed as shown in FIG. 7*c*. Distribution of the wall charges between the scan electrodes Y and the sustain electrodes Z and between the scan electrodes Y and the address electrodes X can be controlled individually by applying the first and second ramp-down pulses Ramp-down1, Ramp-down2 having a different tilt to the scan electrodes Y. As such, if the height of the barrier rib is increased so as to improve the discharge efficiency, it is prevented lots of wall charges of the positive polarity from being formed in the scan electrodes Y and lots wall charges of the negative polarity from being form in the sustain electrodes Z. Resultantly, an excessive erase is not generated between the scan electrode Y and the sustain electrodes Z, and a stabilized address discharge can be generated in the address period accordingly.

In the address period, simultaneously when a scan pulse scan of the negative polarity is sequentially applied to the scan electrodes Y, a data pulse data of the positive polarity, which has a data voltage (Vd), is applied to the address electrodes X.

As a voltage difference between the scan pulse scan and the data pulse data and the wall voltage generated in the reset period are added, an address discharge is generated within cells to which the data pulse data is applied. Wall charges are thus formed in cells selected by the address discharge. In this time, a DC voltage of the positive polarity, which is lower than the sustain voltage level (Vs), is applied to the sustain electrodes Z so that the address discharge is generated between the scan electrode Y and the address electrodes X.

In the sustain period, a sustain pulse Sus is alternately applied to the scan electrodes Y and the sustain electrodes Z. Then, in cells selected by the address discharge, a sustain discharge is generated in a surface discharge shape between the scan electrode Y and the sustain electrodes Z whenever the sustain pulse Sus is applied as the wall voltage and the sustain pulse Sus within the cells are added. Finally, after the sustain discharge is completed, an erase ramp pulse erase having a small pulse width is applied to the sustain electrodes Z, thus erasing the wall charges within the cells.

Figure 8:
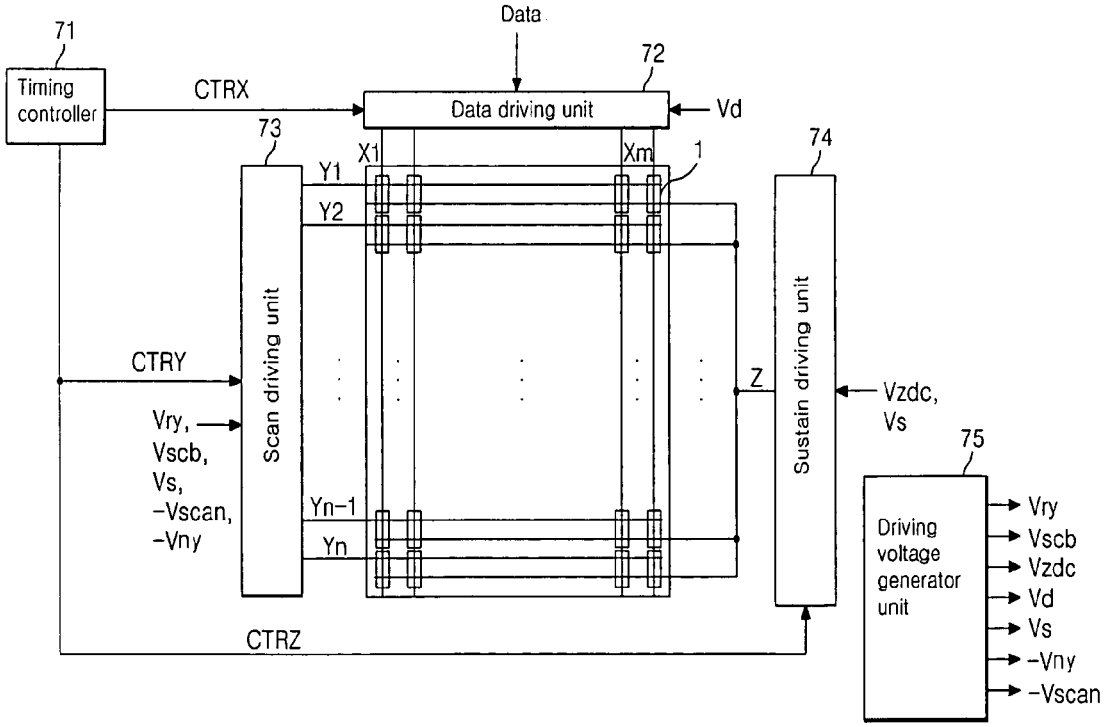
FIG. 8 is a block diagram illustrating the construction of an apparatus for driving the PDP for generating the driving waveform shown in FIG. 6.

FIG. 8 is a block diagram illustrating the construction of an apparatus for driving the PDP for generating the waveform shown in FIG. 6 according to an embodiment of the present invention.

Referring to FIG. 8, the apparatus includes a data driving unit 72 for supplying data to address electrodes X1 to Xm, a scan driving unit 73 for driving scan electrodes Y1 to Yn, a sustain driving unit 74 for driving a sustain electrode Z being a common electrode, a timing controller 71 for controlling the respective driving units 72, 73 and 74, and a driving voltage generator 75 for supplying driving voltages which are necessary for the respective driving units 72, 73 and 74 thereto.

The data driving unit 72 is supplied with data which undergo inverse-gamma correction and error diffusion operations by an inverse-gamma correction circuit and an error diffusion circuit (not shown and are then mapped to respective sub-fields by a sub-field mapping circuit. The data driving unit 72 serves to sample and latch the data in response to a timing control signal CTRX from the timing controller 71 and to supply the data to the address electrodes X1 to Xm.

The scan driving unit 73 supplies the ramp-up pulse Ramp-up to the scan electrodes Y1 to Yn during the set-up period of the reset period, the first ramp-down pulse Ramp-down1 having the first tilt to the scan electrodes Y1 to Yn during the "a" period of the set-down period, and the second ramp-down pulse Ramp-down2 having the second tilt to the scan electrodes Y1 to Yn during the "b" period, under the control of the timing controller 71. In this time, the first tilt is set to be lower than the second tilt. Furthermore, the scan driving unit 73 sequentially applies the scat pulse to the scan electrodes Y1 to Yn during the address period, and then applies the sustain pulse Sus to the scan electrodes Y1 to Yn during the sustain period, under the control of the timing controller 71.

The sustain driving unit 74 provides the ground voltage or 0 V to the sustain electrodes Z during the set-up period of the reset period, the positive-polarity DC voltage of the sustain voltage level (Vs) to the sustain electrodes Z during the "a" period of the set-down period, and then the ground voltage or 0 V to the sustain electrodes Z during the "b" period of the set-down period, under the control of the timing controller 71. Furthermore, the sustain driving unit 74 constantly supplies a DC voltage (Vzdc), which is lower than the sustain voltage (Vs), to the sustain electrodes Z1 to Zn during the address period under the control the timing controller 71, and then supplies the sustain pulse Sus to the sustain electrodes Z during the sustain period, while operating alternately with the scan driving unit 73.

The timing controller 71 receives vertical/horizontal synchronization signals, generates timing control signals CTRX, CTRY and CTRZ which are necessary for the driving units, respectively, and supplies the timing control signals CTRX, CTRY and CTRZ to corresponding driving units 72, 73 and 74, thereby controlling the driving units 72, 73 and 74. The data control signal CTRX includes a sampling clock for sampling a data, a latch control signal, and a switch control signal for controlling an on/off time of an energy recovery circuit and a driving switch element. The scan control signal CTRY includes a switch control signal for controlling an on/off time of an energy recovery circuit and a driving switch element within the scan driving unit 73. Also, the sustain control signal CTRZ includes a switch control signal for controlling an on/off time of an energy recovery circuit and a driving switch element within the sustain driving unit 74.

The driving voltage generator 75 serves to generate the voltage (Vry) of the ramp-up pulse Ramp-up, the voltage (−Vny) of the second ramp-down pulse Ramp-down2, the DC voltage (Vzdc) supplied to the sustain electrodes Z during the address period, a scan bias voltage (Vscb), a scan voltage (−Vscan), the sustain voltage (Vs), the data voltage (Vd) and the like. It is to be noted that these driving voltages may vary depending on the composition of a discharge gas or the construction of a discharge cell.

Figure 9:
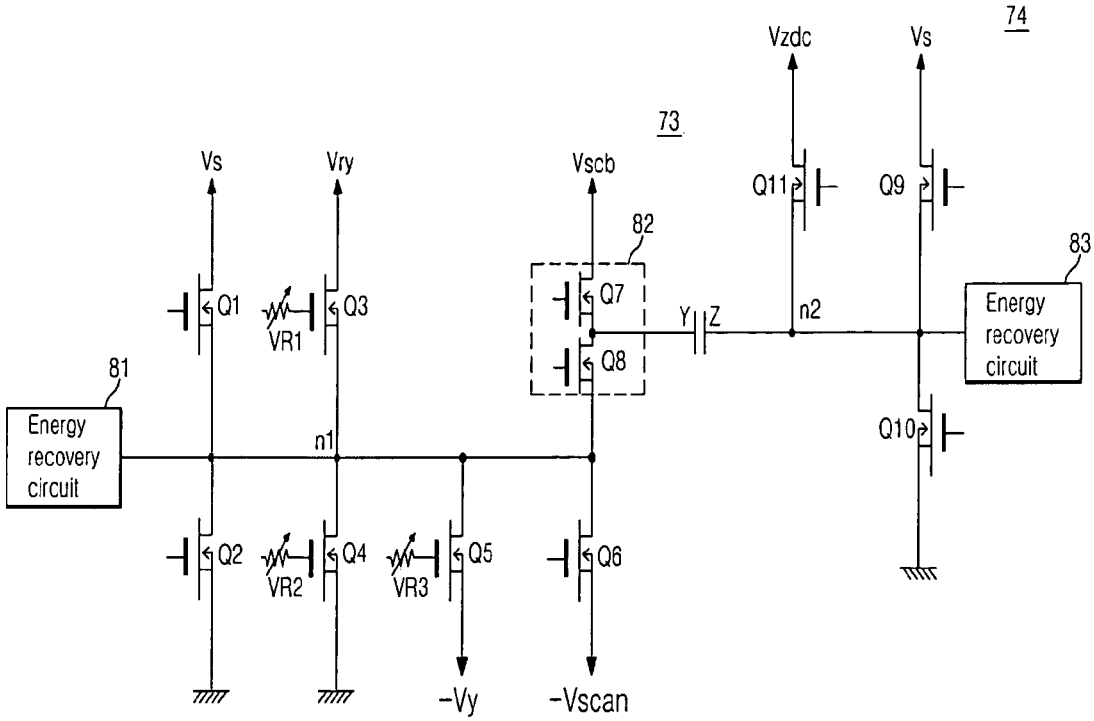
FIG. 9 is a detailed circuit diagram of the scan driving unit and the sustain driving unit shown in FIG. 8.
Figure 10:
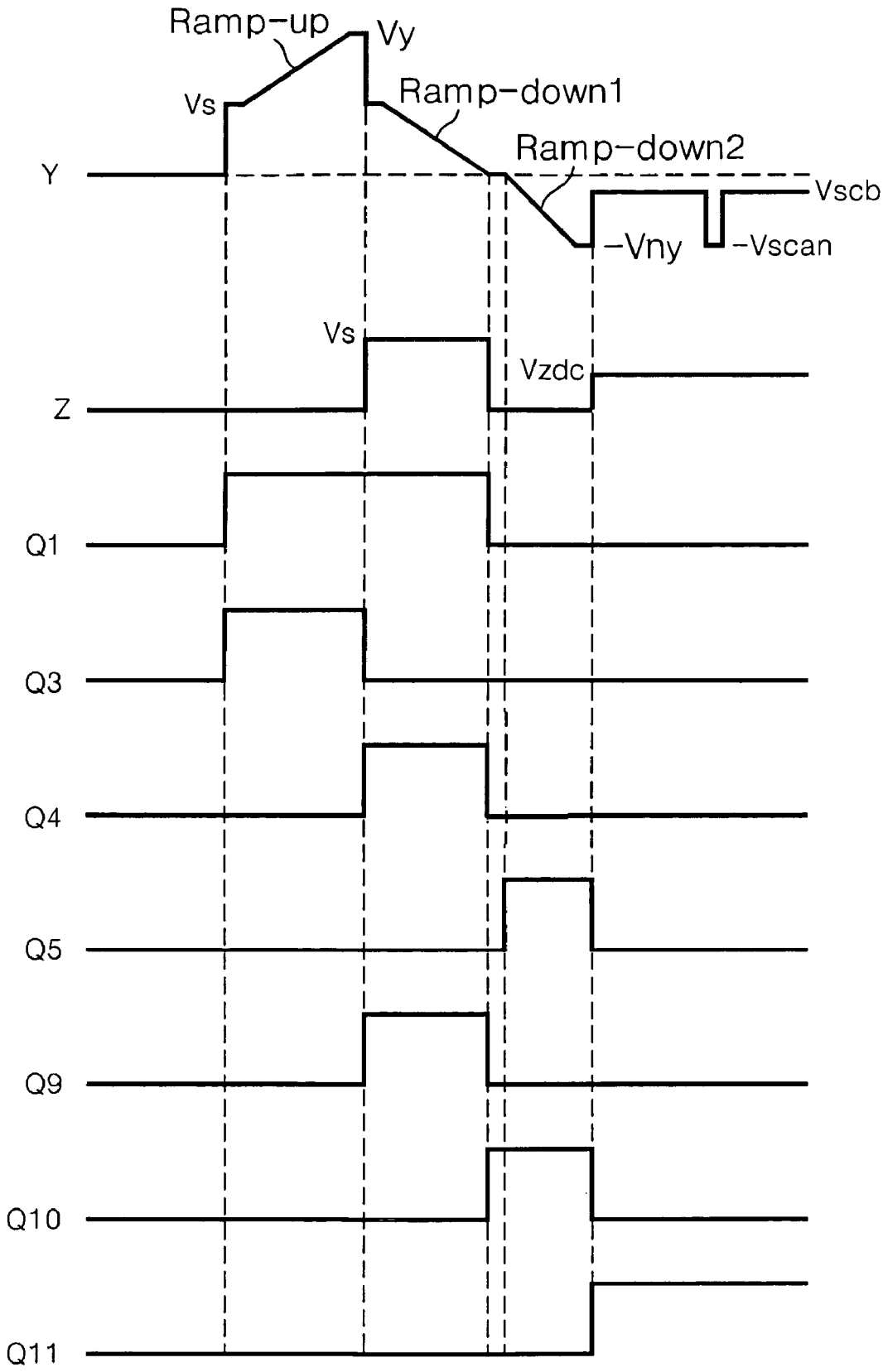
FIG. 10 shows a waveform for explaining the operation of the switch element shown in FIG. 9.

FIG. 9 is a detailed circuit diagram showing some of the scan driving unit 73 and the sustain driving unit 74 for driving the pair of the scan electrodes Y and the sustain electrodes Z. FIG. 10 is a waveform showing the operational timing of switch elements included in the scan driving unit 73 and the sustain driving unit 74.

Referring FIGS. 9 and 10, the scan driving unit 73 includes an energy recovery circuit 81, a driving switch circuit 82, and first to sixth switch elements Q1 to Q6.

The energy recovery circuit 81 recovers energy of invalid power, which does not contribute to a discharge in a PDP, from the scan electrodes Y, and charges the scan electrodes Y with the recovered energy. The energy recovery circuit 81 can be implemented using any known energy recovery circuit.

The driving switch circuit 82 includes a scan bias voltage source (Vscb), and seventh and eighth switch elements Q7, Q8 which are connected between first nodes n1 in a push-pull shape.

The output terminal between the seventh and eighth switch elements Q7, Q8 is connected to the scan electrodes Y. Each of the seventh and eighth switch elements Q7, Q8 supplies the scan bias voltage (Vscb) or the voltage on the fast node n1 to the scan electrodes, Y under the control of the timing controller 71. The first switch element Q1 is connected between a sustain voltage source (Vs) and the first node n1, and provides the sustain voltage (Vs) to the first node n1 under the control of the timing controller 71.

The second switch element Q2 is connected between a ground voltage source (GND) and the first node n1, and supplies the ground voltage (GND) to the first node n1 under the control of the timing controller 71.

The third switch element Q3 is connected between a ramp-up voltage source (Vry) and the first node n1. The third switch element Q3 applies a ramp-up pulse Ramp-up to the first node n1 at a tilt, which is determined according to a preset RC time constant, under the control of the timing controller 71. To the control terminal of the third switch element Q3 is connected a variable resistor VR1 and a capacitor (not shown), for controlling the tilt of the ramp-up pulse Ramp-up.

The fourth switch element Q4 is connected between the ground voltage source (GND) and the first node n1. The fourth switch element Q4 applies a first ramp-down pulse Ramp-down1 to the first node n1 at a tilt, which is determined according to a preset RC time constant, under the control of the timing controller 71. To the control terminal of the fourth switch element Q4 is connected a variable resistor VR2 and a capacitor (not shown), for controlling the tilt of the first ramp-down pulse Ramp-down1.

The fifth switch element Q5 is connected between a ramp-down voltage source (−Vy) and the first node n1. The fifth switch element Q5 supplies a second ramp-down pulse Ramp-down2 to the first node n1 at a tilt, which is determined according to a preset RC time constant, under the control of the timing controller 71. To the control terminal of the fifth switch element Q5 is connected a variable resistor VR3 and a capacitor (not shown), for controlling the tilt of the second ramp-down pulse Ramp-down2.

The sixth switch element Q6 is connected between the scan voltage source and the first node n1, and supplies the scan voltage (−Vscan) to the first node n1 under the control of the timing controller 71.

The sustain driving unit 74 includes an energy recovery circuit 83, and ninth to eleventh switch elements Q9 to Q11.

The energy recovery circuit 83 recovers energy of invalid power which does not contribute to a discharge in the PDP from the sustain electrodes Z, and charges the sustain electrodes Z with the recovered energy. The energy recovery circuit 83 can be implemented using any known energy recovery circuit.

The ninth switch element Q9 is connected between the sustain voltage source (Vs) and the second node n2, and supplies a sustain voltage (Vs) to the second node n2, i.e., the sustain electrodes Z, under the control of the timing controller 71.

The tenth switch element Q10 is connected between the ground voltage source (GND) and the second node n2, and supplies the ground voltage (GND) to the second node n2 under the control of the timing controller 71.

The eleventh switch element Q11 is connected between a DC voltage source (Vzdc) the voltage of which is lower than the sustain voltage (Vs) and the second node n2, and supplies the DC voltage (Vzdc) to the second node n2 during the address period under the control of the timing controller 71.

Figure 11:
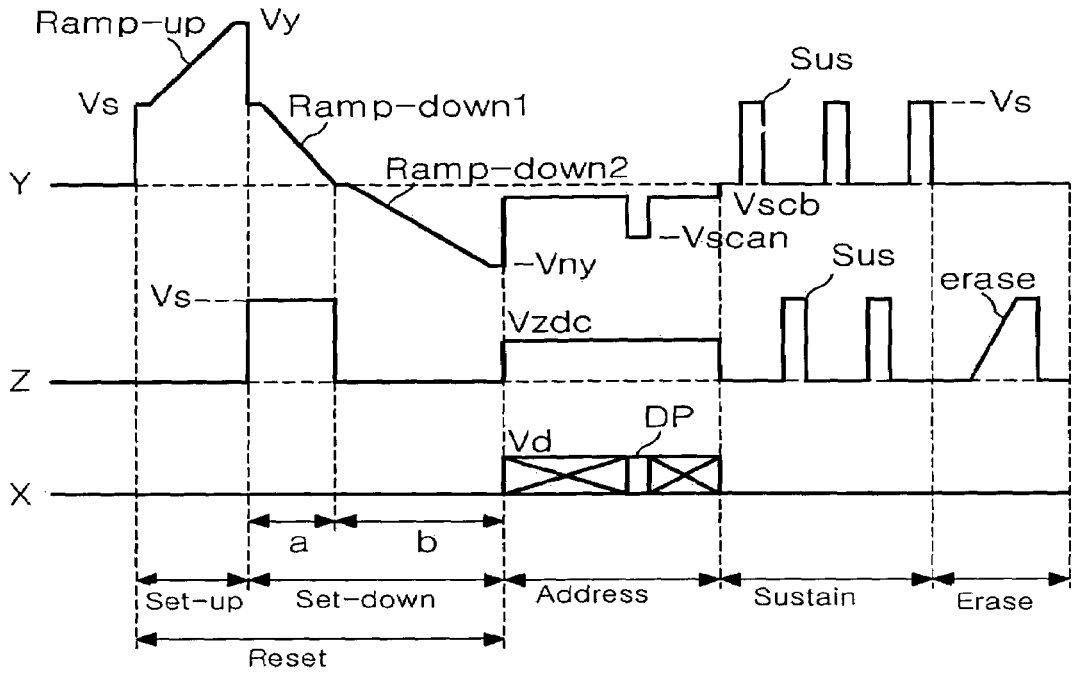
FIGS. 11 and 12 show waveforms for explaining a method of driving a PDP, which is different from that shown in FIG. 6.
Figure 12:
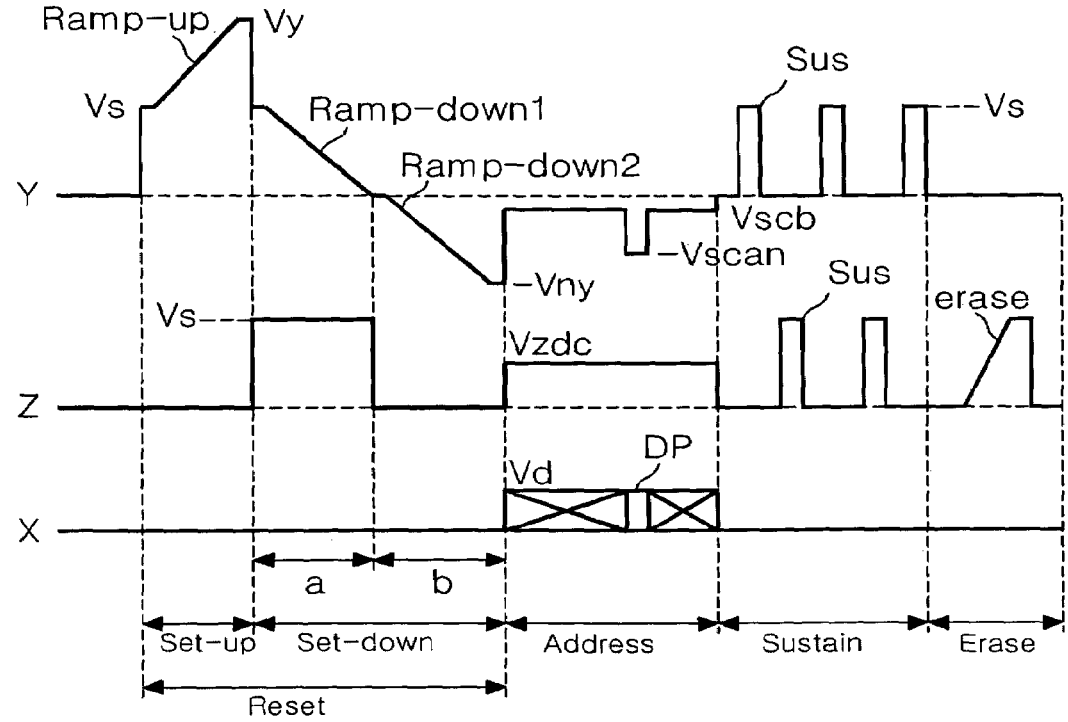

In the method of driving the PDP according to the present invention, as shown in FIG. 11, the tilt of the first ramp-down pulse Ramp-down1 which is supplied during the "a" period of the set-down period of the reset period can be set to be higher than that of the second ramp-down pulse Ramp-down2 which is supplied in the "b" period. Furthermore, as shown in FIG. 12, the tilt of the first ramp-down pulse Ramp-down1 that is supplied in the "a" period of the set-down period of the reset period can be set to be the same as that of the second ramp-down pulse Ramp-down2 that is supplied in the "b" period.

As such, by setting the tilts of the first and second ramp-down pulses Ramp-down1, Ramp-down2 that are supplied in the set-down period to be the same or different, it is possible to effectively cope with conditions of various panels. That is, during the "a" period of the set-down period, the first ramp-down pulse Ramp-down1 is supplied to control wall charges between the scan electrodes Y and the sustain electrodes Z. During the "b" period of the set-down period, the second ramp-down pulse Ramp-down2 a tilt of which is the same as or different from that of the first ramp-down pulse Ramp-down1 is supplied to control wall charges between the scan electrodes Y and the address electrodes X. It is thus possible to effectively meet conditions of various panels.

As described above, according to the present invention, in a panel in which a barrier rib is heightened so as to improve discharge efficiency, first and second ramp-down pulses having the same tilt or a different tilt are applied during a set-down period of a reset period. Thus, distribution of wall charges between scan electrodes and sustain electrodes and between the scan electrodes and address electrodes is individually controlled. Accordingly, the present invention has an effect in that it can generate a reset discharge and an address discharge stably.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of driving a plasma display panel, comprising the steps of:

applying a first ramp-down pulse having a first tilt to scan electrodes in the first half of a set-down period included in a reset period, wherein the first ramp-down pulse starts at a first voltage;

applying a ground voltage to the scan electrodes in the middle phase of the set-down period, wherein the ground voltage is held for a predetermined amount of time; and applying a second ramp-down pulse having a second tilt to the scan electrodes in the second half of the set-down period after holding the voltage of scan electrode at ground for the predetermined amount of time, wherein the second ramp-down pulse starts at a second voltage different from the first voltage.

2. The method as claimed in claim 1, wherein the first voltage is a sustain voltage level and the first ramp-down pulse drops from the sustain voltage level to the ground voltage.

3. The method as claimed in claim 2, wherein the second voltage is the ground voltage and the second ramp-down pulse drops from the ground voltage to a voltage level of the negative polarity.

4. The method as claimed in claim 3, wherein the voltage level of the negative polarity is a voltage of −100 V or less.

5. The method as claimed in claim 1, wherein the first tilt and the second tilt are set to be the same.

6. The method as claimed in claim 1, wherein the first tilt and the second tilt are set to be different.

7. The method as claimed in claim 6, wherein the first tilt is set to be higher than the second tilt.

8. The method as claimed in claim 6, wherein the first tilt is set to be lower than the second tilt.

9. The method as claimed in claim 1, wherein in the first half of the set-down period, a first voltage of the positive polarity is supplied to the sustain electrodes.

10. The method as claimed in claim 9, wherein in the second half of the set-down period, the ground voltage is supplied to the sustain electrodes.

11. The method as claimed in claim 10, wherein a second voltage of the positive polarity, which is lower than the first voltage of the positive polarity, is supplied to the sustain electrodes during an address period.

12. A method of driving a plasma display panel in which a reset period is divided into a set-up period and a set-down period and is then driven, comprising:

a first step in which wall charges are formed in a discharge cell during the set-up period;

a second step in which some of the wall charges are erased by a discharge between scan electrodes and sustain electrodes during the first half of the set-down period;

after the second step, supplying a ground voltage to the scan electrode, wherein the ground voltage is held for a predetermined amount of time; and a third step in which some of the wall charges are erased by a discharge between the scan electrodes and address electrodes in the second half of the set-down period after supplying and holding the scan electrode at ground voltage for the predetermined amount of time.

13. An apparatus for driving a plasma display panel in which a plurality of sub-fields are divided into a reset period, an address period and a sustain period and are then driven, comprising:

a scan driving unit that supplies a first ramp-down pulse which drops from a sustain voltage to a ground voltage at a first tilt in the first half of a set-down period included in the reset period, supplies the ground voltage in the middle phase of the set-down period, wherein the ground voltage is supplied and held for a predetermined amount of time, and supplies a second ramp-down pulse which drops from the ground voltage to a voltage of the negative polarity at a second tilt in the second half of the set-down period, after supplying the ground voltage; and a sustain driving unit that supplies the sustain voltage in the first half of the set-down period and the ground voltage in the second half of the set-down period.

14. The apparatus as claimed in claim 13, wherein the sustain driving unit supplies a voltage of the positive polarity that is lower than the sustain voltage to sustain electrodes during the address period.

15. The apparatus as claimed in claim 13, wherein the first tilt and the second tilt are set to be the same.

16. The apparatus as claimed in claim 13, wherein the first tilt and the second tilt are set to be different.

17. The apparatus as claimed in claim 16, wherein the first tilt is set to be higher than the second tilt.

18. The apparatus as claimed in claim 16, wherein the first tilt is set to be lower than the second tilt.

19. The apparatus as claimed in claim 13, wherein the scan driving unit comprises:

a first ramp supply unit for supplying the first ramp-down pulse having the first tilt; and a second ramp supply unit for supplying the second ramp-down pulse having the second tilt.

20. The apparatus as claimed in claim 19, wherein the first ramp supply unit comprises:

a first switch connected to a sustain voltage source;

a second switch connected to a ground voltage source; and a first variable resistor connected to the gate terminal of the second switch, for controlling the first tilt of the first ramp-down pulse.

21. The apparatus as claimed in claim 20, wherein the second ramp supply unit comprises:

a third switch connected to a negative-polarity voltage source; and a second variable resistor connected to the gate terminal of the third switch, for controlling the second tilt of the second ramp-down pulse.

22. The apparatus as claimed in claim 21, wherein the negative-polarity voltage source supplies a voltage of −100 V or less.

* * * * *